US005393601A

United States Patent [19]

Heinrich et al.

[11] Patent Number: 5,393,601

[45] Date of Patent: Feb. 28, 1995

[54] NON-WOVEN SOLIDIFIED BY MEANS OF A MELT BINDER

[75] Inventors: Karl Heinrich, Grossbaitingen; Hans-Joachim Brüning, Augsburg; Elke Gebauer, Bobingen, all of Germany

[73] Assignee: Hoechst Aktiengesellschaft, Frankfurt am Main, Germany

[21] Appl. No.: 823,376

[22] Filed: Jan. 21, 1992

[30] Foreign Application Priority Data

Jan. 22, 1991 [DE] Germany ..... 4101674

[51] Int. Cl.[6] ..... B32B 27/34; B32B 3/26; B32B 27/08; D04H 1/58

[52] U.S. Cl. ..... 428/287; 55/528; 162/146; 162/157.3; 162/164.6; 162/201; 162/206; 162/207; 156/155; 210/507; 210/508; 264/122; 264/126; 428/288; 428/311.5; 428/474.4; 428/474.7

[58] Field of Search ..... 428/474.7, 474.4, 287, 428/288, 920, 311.5; 162/146, 157.3, 164.6, 201, 206, 207; 210/507, 508; 55/528; 264/126, 122; 156/155

[56] References Cited

U.S. PATENT DOCUMENTS 3,756,908 9/1973 Gross .
4,029,835 6/1977 Iwata et al. .
4,229,397 10/1980 Fukuta et al. ..... 264/113
4,482,603 11/1984 Yoshida et al. .
4,888,091 12/1989 Nollen et al. .
4,992,141 2/1991 Sullivan .
5,094,794 3/1992 Croman ..... 428/474.7
5,094,913 3/1992 Yang .
5,124,900 6/1992 Varey et al. ..... 362/351

FOREIGN PATENT DOCUMENTS 0392559 10/1990 European Pat. Off. .

OTHER PUBLICATIONS

Abstracts of U.S. Pat. No. 5,094,913 (Yang), issued Mar. 10, 1992.
*Chemical Abstracts* 110 (26): 233313.
*Chemical Abstracts* 114 (2): 11090.

*Primary Examiner*—James C. Cannon

[57] ABSTRACT

A non-woven solidified by means of a melt binder is described, which is based on supporting aramid fibers and on binding fibers made of thermoplastic aramids whose melting point is below the melting or decomposition point of said supporting aramid fibers. In the non-woven, the binding fibers are virtually completely melted. The non-wovens are distinguished by high strength.

18 Claims, No Drawings

NON-WOVEN SOLIDIFIED BY MEANS OF A MELT BINDER

The present invention relates to a novel non-woven solidified by means of a melt binder and based on aramid fibers, to a process for its preparation, and the use of this non-woven as filter material, as insulating material or as reinforcing material.

Non-wovens are generally known and are a special category of textile sheet structures. In contrast to conventional textile sheet structures, such as woven fabrics and knitted fabrics, non-wovens are formed directly from individual fibers or filaments. The cohesion of such non-wovens can be brought about by the inherent adhesion of the fibers and/or by mechanical and/or by chemical solidification.

A heat-resistant web material which is produced by compressing or heating a woven or knitted fabric or a web material comprising a blend of aromatic polyamide fibers is disclosed in DE-A-2,600,209. One type of these fibers acts as a binder and the other type acts as a supporting fiber. The hot-melt treatment deforms the binding fiber with the formation of a porous web material, which can be readily impregnated with varnish. The necessary strength is only achieved by impregnation.

A filter material comprising glass fibers which are solidified by means of aromatic polyamide fibers is disclosed in US-A-3,920,428. Here too, the polymer fibers are deformed by heat and effect solidification of the glass fiber mat by a sort of "sintering process". The strength of these glass fiber mats likewise still leaves something to be desired.

The object of the present invention is to provide a novel non-woven comprising aromatic polyamides and having improved strength.

This object is achieved by the non-woven as claimed in claim 1.

As a result of the virtually complete melting of the binding fibers and the joining of the material forming these fibers at the crossing points of the supporting aramid fibers, in most cases with the formation of so-called "binder sails", a considerable increase in the strength of the non-wovens is observed.

In the context of the present description, the term "aramid" is understood to mean a polyamide which has a substantial portion of aromatic radicals in the polymer chain, for example has been synthesized for more than 80 mol % from aromatic monomer units.

For preparing the non-woven according to the invention, virtually any combinations of aramid fibers can be used, as long as the binding fiber is made of thermoplastic aramid and the supporting fiber has a higher melting or decomposition point than the melting point of the binding fiber, so that the binding fiber can be melted virtually completely without significantly changing the supporting fiber.

Meltable and non-meltable aramid fibers can be used as the supporting fibers. Furthermore, the strength and the modulus of the supporting aramid fibers can be selected within wide limits.

Examples of aramid fibers of high strength and high modulus are substantially aramids synthesized from p-aromatic radicals, such as poly(p-phenyleneterephthalamide). Examples of these are the products KEVLAR ® 29 and KEVLAR ® 49 from Du Pont. These aramids are insoluble in organic solvents.

Examples of aramid fibers of medium strength and medium modulus are aramids which have a substantial proportion of aromatic m-compounds, such as poly(m-phenyleneterephthalamide), poly(m-phenyleneisophthalamide) or poly(p-phenyleneisophthalamide). Examples of these aramids are the products NOMEX ® from Du Pont. These aramids are insoluble in conventional solvents.

Preferably, supporting fibers made of aramids which are soluble in organic solvents, in particular made of those aramids which are soluble in polar aprotic solvents, such as dimethylformamide or dimethyl sulfoxide, are used.

These include, for example, soluble aromatic polyamides based on terephthalic acid and 3-(p-aminophenoxy)-4-aminobenzanilide, such as described in DE-A-2,144,126; or aromatic polyamides based on terephthalic acid, p-phenylenediamine and 3,4'-diaminodiphenyl ether, such as described in DE-C-2,556,883 and in DE-A-3,007,063, or aromatic polyamides based on terephthalic acid and selected portions of selected diamines, such as described in DE-A-3,510,655, 3,605,394 and EP-A-199,090.

Particularly preferably, supporting aramid fibers made of copolyamides soluble in organic polyamide solvents are used, which contain at least 95 mol %, relative to the polyamide, of recurring structural units of the formulae Ia, Ib, Ic and Id $$-OC-Ar^1-CO-, \quad \text{(Ia)}$$

(Ib)

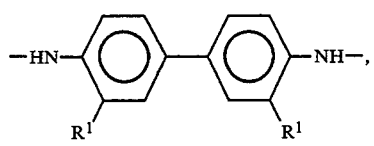

(Ic)

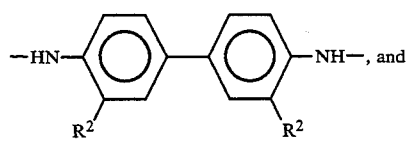

(Id)

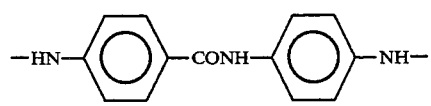

and up to 5 mol % of structural units (Ie) and/or (If) containing m-bonds and derived from aromatic dicarboxylic acids and/or from aromatic diamines, the sums of the molar proportions of structural units (Ia)+(Ie) and of the molar proportions of structural units (Ib)+(Ic)+(Id)+(If) being substantially identical, and the proportions of diamine components (Ib), (Ic) and (Id) being within the following limits, relative to the total amount of this diamine component:

structural unit (Ib): 30–55 mol %,
structural unit (Ic): 15–35 mol %,
structural unit (Id): 20–40 mol %;

or containing at least 95 mol %, relative to the polyamide, of recurring structural units of the formulae Ia, Ig, Ib and Id $$-OC-Ar^1-CO-, \quad \text{(Ia)}$$

$$-HN-Ar^2-NH-, \quad \text{(Ig)}$$

-continued (Ib)

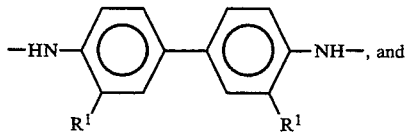

(Id)

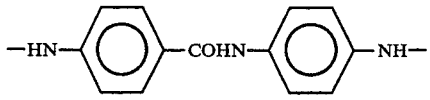

and up to 5 mol % of structural units (Ie) and/or (If) containing m-bonds and derived from aromatic dicarboxylic acids and/or from aromatic diamines, the sums of the molar proportions of structural units (Ia)+(Ie) and of the molar proportions of structural units (Ig)+(Ib)+(Id)+(If) being substantially identical, and the proportions of diamine components (Ig), (Ib) and (Id) being within the following limits, relative to the total amount of these diamine components:

structural units (Ig): 15–25 mol %,
structural units (Ib): 45–65 mol %,
structural units (Id): 15–35 mol %;

or containing at least 95 mol %, relative to the polyamide, of recurring structural units of the formulae Ia, Ig, Ib and Ic $$-OC-Ar^1-CO-, \quad \text{(Ia)}$$

$$-HN-Ar^2-NH-, \quad \text{(Ig)}$$

(Ib)

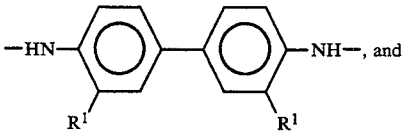

(Ic)

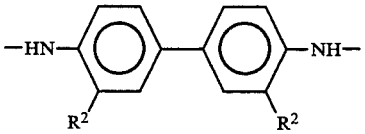

and up to 5 mol % of structural units (Ie) and/or (If) containing m-bonds and derived from aromatic dicarboxylic acids and/or from aromatic diamines, the sums of the molar proportions of structural units (Ia)+(Ie) and of the molar proportions of structural units (Ig)+(Ib)+(Ic)+(If) being substantially identical, and the proportions of diamine components (Ig), (Ib) and (Ic) being within the following limits, relative to the total amount of these diamine components:

structural units (Ig): 20–30 mol %,
structural units (Ib): 35–55 mol %,
structural units (Ic): 15–40 mol %;

in these formulae (Ia) to (Ig)

$-Ar^1-$ and $-Ar^2-$ are divalent aromatic radicals whose valence bonds are in the para or comparable coaxial or parallel position and which can be substituted by one or two inert radicals, such as alkyl, alkoxy or halogen, and $-R^1$ and $-R^2$ are lower alkyl radicals or lower alkoxy radicals or halogen atoms, each of which are different from one another. Examples of $-Ar^1-$ and $-Ar^2-$ are naphthalene-1,4-diyl and preferably p-phenylene.

Aramids containing these structural units of the formulae (Ia) to (Ig) are disclosed in EP-A-364,891, 364,892 and 364,893, and the contents of these applications are likewise the contents of the present description.

Any thermoplastic aramid fibers known per se can be used as binding fibers, as long as these fibers can be melted virtually completely and bond the supporting aramid fibers. In most cases, this takes place with the formation of so-called "binder sails". Preferably, thermoplastic aramid fibers are used which are soluble in organic solvents.

Particularly preferably, binding fibers based on thermoplastic aromatic polyether amides are used.

These include, for example, the aromatic copolyether amides disclosed in DE-A-3,818,208 or in DE-A-3,818,209; furthermore, aromatic polyamides disclosed in EP-A-366,316, EP-A-384,980, EP-A-384,981 and EP-A-384,984 can also be used.

Particularly preferably, binding fibers made of thermoplastic aromatic copolyether amides of the formula II are used $$R^3\left[NH-Ar^4-NH\right]_x\left[\overset{O}{\overset{\|}{C}}-Ar^3-\overset{O}{\overset{\|}{C}}\right]_y, \qquad \text{II}$$

$$\left[NH-Ar^5-O-Ar^6-y-Ar^6-O-Ar^5-NH\right]_z R^3$$

in which $Ar^3$ is a divalent substituted or unsubstituted aromatic radical whose free valences are in the para or meta position or in a comparable parallel or angled position relative to one another, $Ar^4$ can have one of the meanings given for $Ar^3$ or is a group $-Ar^7-Z-Ar_7-$, in which Z is a $-C(CH_3)_2-$ or $-O-Ar^7-O-$ bridge and $Ar^7$ is a divalent aromatic radical, $Ar^5$ and $Ar^6$ are identical to or different from one another and are a substituted or unsubstituted para- or metaarylene radical, Y is a $-C(CH_3)_2-$, $SO_2-$, $-S-$ or $-C(CF_3)_2-$ bridge, in which a) the polyether amide has an average molecular weight (number average) in the range from 5,000 to 50,000, b) molecular weight control takes place selectively by non-stoichiometric addition of the monomer units, where the sum of the molar fractions x, y and z is one, the sum of x and z is not y and x can adopt the value zero, and c) the ends of the polymer chain are virtually completely capped by monofunctional radicals $R^3$ which do not further react in the polymer and which, independently of one another, can be identical or different.

Binding fibers which are based on these aramids can be processed like a thermoplastic, are distinguished by a particularly good melting behavior and lead to nonwovens having excellent strength.

$Ar^3$ can be a mononuclear or fused binuclear aromatic divalent radical or a radical of the formula $-Ar^7-Q-Ar^7-$, in which $Ar^7$ has the meaning defined above and Q is a direct C—C bond or an —O—, —CO—, —S—, —SO—or $-SO_2-$ bridge.

$Ar^3$ can be heterocyclic-aromatic or preferably carbocyclic-aromatic radicals. Heterocyclic-aromatic radicals preferably have one or two oxygen and/or sulfur and/or nitrogen atoms in the ring.

$Ar^5$ and $Ar^6$ are in general carbocyclic-aromatic arylene radicals whose free valences are in the para or meta position or in a comparable parallel or angled position relative to one another, and are preferably mononuclear aromatic radicals.

$Ar^7$ in general has one of the meanings defined for $Ar^5$ or $Ar^6$.

Examples of $—Ar^3—$, $—Ar^4—$, $—Ar^5—$ and $—Ar^6—$ radicals are p-phenylene, m-phenylene, biphenyl-4,4'-diyl or naph-thalene-1,4-diyl.

Examples of substituents, which are optionally present on the radicals $—Ar^1—$ to $—Ar^6—$, are branched or in particular straight-chain $C_1—C_6$—alkyl radicals, such as methyl, ethyl, n-propyl, isopropyl, n-butyl, n-pentyl or n-hexyl, and the corresponding perfluoro derivatives having up to six carbon atoms or the corresponding alkoxy derivatives. Methyl is preferred.

Examples of halogen substituents are bromine or in particular chlorine.

The aromatic polyether amides preferably used according to the invention of the formula II are prepared by selective molecular weight control by non-stoichiometric addition of the monomer units, in which the sum of the molar fractions x, y and z is one, but the sum of x and z may not be y and x can adopt the value zero. In a preferred embodiment, z is greater than x.

After completion of the polycondensation reaction, the ends of the polymer chain are completely capped by addition of reagents which react to give groups which do not further react in the polymer. These end groups are independent of one another and can be identical or different and are preferably selected from a group comprising the formulae III, IV, V and/or VI.

(III)

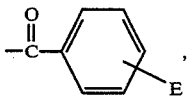

(IV)

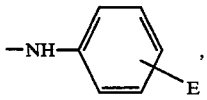

(V)

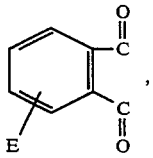

(VI)

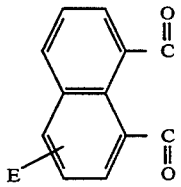

In the case where the end groups are V and/or VI, the terminal nitrogen in formula (II) is an imide nitrogen.

In the abovementioned formulae, E is a hydrogen or halogen atom, in particular a chlorine, bromine or fluorine atom, or an organic radical, for example an aryl (oxy) group.

The aromatic polyether amide of the formula II can be prepared by reaction of one or more dicarboxylic acid derivatives with one or more diamines by the solution, precipitation or melt condensation process, in which one of the components is used in less than a stoichiometric amount and a chain-capping agent is added after the polycondensation is complete.

It has been found that thermoplastic aromatic polyether amides having very good mechanical properties can be prepared via conventional techniques, if a) the molecular weight is selectively controlled by use of non-stoichiometric amounts of the monomers, b) the ends of the polymer chain are completely capped by monofunctional compounds which do not further react in the polymer, and preferably c) the content of inorganic impurities in the polymer does not exceed 500 ppm after workup and isolation.

The thermoplastic aromatic polyamides preferably used according to the invention of the formula II are furthermore distinguished by having an average molecular weight in the range from 5000 to 50,000 and a low melt viscosity not exceeding 10,000 Pas.

For preparing these preferred polyether amides, the following compounds are suitable:

Dicarboxylic acid derivatives of the formula (VII)

$$W—CO—Ar^3—CO—W \quad (VII)$$

in which $Ar^3$ has the abovementioned meaning and W can be a fluorine, chlorine, bromine or iodine atom, preferably a chlorine atom, or an —OH or $OR^4$ group, in which $R^4$ is a branched or unbranched aliphatic or aromatic radical.

Examples of compounds of the formula (VII) are:

terephthalic acid
terephthaloyl chloride
diphenyl terephthalate
isophthalic acid
diphenyl isophthalate
isophthaloyl chloride
phenoxyterephthalic acid
phenoxyterephthaloyl chloride
diphenyl phenoxyterephthalate
di(n-hexyloxy)terephthalic acid
bis(n-hexyloxy)terephthaloyl chloride
diphenyl bis(n-hexyloxy)terephthalate
2,5-furandicarboxylic acid
2,5-furandicarbonyl chloride
diphenyl 2,5-furandicarboxylate
thiophenedicarboxylic acid
naphthalene-2,6-dicarboxylic acid
oxy-4,4'-dibenzoic acid
benzophenone-4,4'-dicarboxylic acid
isopropylidene-4,4'-dibenzoic acid
sulfonyl-4,4'-dibenzoic acid
tetraphenylthiophenedicarboxylic acid
sulfinyl-4,4'-dibenzoic acid
thio-4,4'-dibenzoic acid
trimethylphenylindanedicarboxylic acid Suitable aromatic diamines of the formula (VIII)

$$H_2N—Ar^4—NH_2 \quad (VIII)$$

in which $Ar^4$ has the abovementioned meaning, are preferably the following compounds:

m-phenylenediamine
p-phenylenediamine
2,4-dichloro-p-phenylenediamine
diaminopyridine
bis(aminophenoxy)benzene 2,6-bis(aminophenoxy)pyridine
3,3'-dimethylbenzidine
4,4'- and 3,4'-diaminodiphenyl ether
isopropylidene-4,4'-dianiline
p,p'- and m,m'-bis(4-aminophenylisopropylidene)benzene
4,4'- and 3,3'-diaminobenzophenone
4,4'- and 3,3'-diaminodiphenyl sulfone
bis(2-amino-3-methylbenzo)thiophene S,S-dioxide Suitable aromatic diamines are furthermore those of the formula (IX)

$$H_2N—Ar^5—O—Ar^6—Y—Ar^6—O—Ar^5—NH_2 \quad (IX)$$

in which $Ar^5$, $Ar^6$ and Y have the abovementioned meaning.

Suitable aromatic diamines of the formula (IX) are:
2,2-bis [4-(3-trifluoromethyl-4-aminophenoxy)phenyl] propane
bis [4-(4-aminophenoxy)phenyl] sulfide
bis [4-(3-aminophenoxy)phenyl] sulfide
bis [4-(3-aminophenoxy)phenyl] sulfone
bis [4-(4-aminophenoxy)phenyl] sulfone
2,2-bis [4-(4-aminophenoxy)phenyl]propane
2,2-bis [4-(3-aminophenoxy)phenyl]propane
2,2-bis [4-(2-aminophenoxy)phenyl]propane
1,1,1,3,3,3-hexafluoro-2,2-bis[4-(4-aminophenoxy)phenyl ]propane.

The preparation of the polyether amides used according to the invention preferably takes place via solution condensation processes.

The solution condensation of the aromatic dicarbonyl dichloride with the aromatic diamines is carried out in aprotic, polar solvents of the amide type, such as, for example, in N,N-dimethylacetamide, preferably in N-methyl-2-pyrrolidone. If desired, halide salts from group I and/or group II of the periodic table can be added to these solvents in a known manner in order to increase their dissolving capacity or to stabilize the polyether amide solutions. Preferred additives are calcium chloride and/or lithium chloride. In a preferred embodiment, the condensation is carried out without addition of salt, since the aromatic polyether amides described above are distinguished by high solubility in the abovementioned solvents of the amide type.

The polyamides preferably used according to the invention of the formula II make thermoplastic processing by standard methods possible. They can be prepared by using at least one of the starting components in less than a stoichiometric amount. This makes it possible to limit the molecular weight in accordance with the known Carothers equation:

$$P_n = \frac{1+q}{1-q}$$

in which $q \neq 1$ and at the same time q is $y/x+z$.
$P_n$ = degree of polymerization
q = molar ratio of the diacid components to the amine components In the procedure using less than a stoichiometric amount of acid dichloride, a monofunctional aromatic acid chloride or acid anhydride is added at the end of the polymerization reaction as chain-capping agent, for example benzoyl chloride, fluorobenzoyl chloride, biphenylcarbonyl chloride, phenoxybenzoyl chloride or, alternatively, phthalic anhydride, naphthalic anhydride, 4-chloronaphthalic anhydride.

Chain-capping agents of this type can be unsubstituted or substituted, preferably by fluorine or chlorine atoms. Preferably, benzoyl chloride or phthalic anhydride, particularly preferably benzoyl chloride, is used.

If less than a stoichiometric amount of diamine component is used, a monofunctional, preferably aromatic, amine is used after the end of the polycondensation as chain-capping agent, for example fluoroaniline, chloroaniline, 4-amino-diphenylamine, aminobiphenylamine, aminodiphenyl ether, aminobenzophenone or aminoquinoline.

In a particularly preferred embodiment of the polycondensation process, a less than stoichiometric amount of dicarbonyl chloride is polycondensed with diamine and the remaining amino groups are then deactivated by means of a monofunctional acid chloride or diacid anhydride.

In a further preferred embodiment, the diacid chloride is used in less than a stoichiometric amount and polycondensed with a diamine. The remaining reactive amino end groups are then deactivated by means of a monofunctional, preferably aromatic, substituted or unsubstituted acid chloride or acid anhydride.

The chain-capping agent, i.e. the monofunctional amine or acid chloride or acid anhydride, is preferably used in a stoichiometric or more than a stoichiometric amount, relative to the diacid or diamine component.

For the preparation of the aromatic polyamides preferably used according to the invention, the molar ratio q (acid components to diamine components) can be varied in the range from 0.90 to 1.10, exact stoichiometry ($q=1$) of the bifunctional components being excluded. Particularly preferably, the molar ratio is in the range from 0.90 to 0.99 and 1.01 to 1.10, particularly preferably in the range from 0.93 to 0.98 and 1.02 to 1.07, in particular in the range from 0.95 to 0.97 and 1.03 to 1.05.

The polycondensation temperatures are usually between −20 and +120° C. preferably between +10 and +100° C. Particularly good results are obtained at reaction temperatures of between +10 and +80° C. The polycondensation reactions are preferably carried out such that, after the reaction is complete, 2 to 40, preferably 5 to 30, % by weight of polycondensation product are present in the solution. For specific applications, the solution can, if desired, be diluted with N-methyl-2-pyrrolidone or other solvents, for example DMF, DMAC or butylcellosolve, or concentrated under reduced pressure (thin-film evaporator).

After polycondensation is complete, the hydrogen chloride formed which is bound to loosely to the amide solvent is removed by addition of acid-binding auxiliaries. Examples of suitable auxiliaries are lithium hydroxide, calcium hydroxide, but in particular calcium oxide, propylene oxide, ethylene oxide or ammonia. In a particular embodiment, the "acid-binding" agent is pure water, which dilutes the hydrochloric acid and simultaneously serves to precipitate the polymer. For the production of shaped articles according to the present invention, the copolyamide solutions according to the invention and described above are filtered, degassed and further processed in a manner known per se to give aramid fibers or filaments.

If desired, suitable amounts of additives can be added to the solutions. Examples are light stabilizers, antioxidants, flame retardants, antistatics, dyes, colored pigments or fillers.

In order to isolate the polyether amide, a precipitant can be added to the solution, and the coagulated product can be filtered off. Examples of typical precipitants are water, methanol, acetone, which, if desired, may also contain pH-controlling additives, such as, for example, ammonia or acetic acid.

Isolation preferably takes place by comminution of the polymer solution in a cutting mill using an excess of water. The finely comminuted coagulated polymer particles facilitate the subsequent washing steps (removal of subsequent products formed from hydrochloric acid) and the drying of the polymer (avoiding inclusions) after filtration. Nor is subsequent comminution necessary, since a flowable product is formed directly.

Apart from the solution condensation described, which is considered as an easily accessible process, it is also possible, as already mentioned, to use other conventional processes for the preparation of polyamides, such as, for example, melt condensation or solids condensation. These processes too include, apart from condensation with control of the molecular weight, purification or washing steps and the addition of suitable additives. Moreover, it is also possible to add the additives to the isolated polymer during thermoplastic processing.

The aromatic polyamides preferably used according to the invention Of the formula II have surprisingly good mechanical properties and high glass transition temperatures.

The Staudinger index $[\eta]_o$ is in the range from 0.4 to 1.5 dl/g, preferably in the range from 0.5 to 1.3 dl/g, particularly preferably in the range from 0.6 to 1.1 dl/g. The glass transition temperatures are in general above 180° C., preferably above 200° C., the processing temperatures in the range from 320° to 380° C., preferably in the range from 330° to 370° C., particularly preferably in the range from 340° to 360° C.

Processing of these polyamides can take place via extrusion processes, since the melt viscosities do not exceed 10,000 Pas. Extrusion can be carried out on conventional single- or twin-screw extruders.

The preparation of the non-wovens according to the invention can take place in any manner known per se. Staple fibers or short fibers or even continuous filaments from both aramid types can be used. Non-woven formation can take place via dry or wet processing.

If at least one type of fiber is an aramid which is not soluble in organic solvents, it is preferred to select processing via staple or short fibers.

In such a case, it is preferred to produce carded non-wovens. The two types of fibers are preferably blended before carding.

However, the non-wovens according to the invention can also be produced by other techniques of non-woven formation which are customary per se, for example by the wet non-woven technique (in particular for producing paper-like non-wovens) or by the aerodynamic or hydrodynamic non-woven formation (in particular for producing filling non-wovens).

The invention relates in particular to papers based on the non-wovens according to the invention, which contain about 70 to 98% by weight, in particular 80 to 90% by weight, of supporting aramid fibers in the form of staple fibers, which are fibrillated, and contain about 2 to 30% by weight, in particular 10 to 20% by weight, of binding fibers made of thermoplastic aramids which have been solidified by bonding the supporting fibers to the binding fibers by partial melting or by virtually complete melting of the binding fibers.

The staple lengths of the supporting aramid fibers are in general 2 to 6 mm. The fibers can be produced by cutting or tearing. Preferably, fibrillation of these fibers is effected by mechanical processing, for example by treating an aqueous suspension of the aramid staple fibers in a dissolver. The aramid binding fibers are preferably used in the form of staple fibers. The staple length of the binding fibers is preferably about the same as the staple length of the supporting fibers. The binding fibers can be used as such, i.e. prior fibrillation is not absolutely necessary.

To produce the paper, the two types of fibers, which in turn can be present in the form of blends, are mixed with one another. This is in general carried out in aqueous medium. The suspension thus prepared is placed on a sieve tray, the aqueous medium is separated off and the matted fibers remain on the tray. The sheet structure obtained in this manner is stabilized and/or subjected to final solidification by heat treatment. If desired, the heat treatment is carried out under pressure.

Typical temperatures for the solidification step are dependent on the types of fibers selected in the individual case and can be determined by one skilled in the art, using simple test series. The papers produced in this manner either have, depending on the solidification conditions used, virtually no more binding fibers, i.e. the binding fibers have been completely melted by the solidification step thus losing their fiber form, or the melt fibers have been retained to some extent and only partial melting has taken place with bonding of the supporting fibers to the binding fibers.

The papers according to the invention can be used in particular for the production of laminates, for example as top layers in the reinforcing of "honeycomb laminates", such as described in WO-A-84/04727 or in the reinforcing of network materials, such as described in EP-A-158,234.

The non-wovens produced in the first step can, if desired, be presolidified before the final solidification. This can take place, for example, by needling.

Final solidification to give the non-wovens according to the invention is carried out by heating the initially obtained non-woven to a temperature at which the binding fibers melt and/or are deformed like a thermoplastic, forming in most cases so-called "binding sails" at the crossing points of the supporting aramid fibers while losing their fiber structure. Heating can be carried out by treatment with a hot heat-transfer medium, for example with air, or by treatment with hot rolls or calenders which, if desired, have a surface structure and give the non-woven an embossed structure.

The duration of the heat treatment depends, for example, on the desired final properties, on the dimensions of the non-woven and the nature of the types of fibers forming the non-woven. The melting point of the binding fibers is usually at least 10° C. below the melting or decomposition point of the supporting fibers, in particular more than 30° C. below the melting or decomposition point of the supporting fibers.

Preferably, the melting point selected of the binding fibers is sufficiently below the melting or decomposition point of the supporting fibers so as not to cause significant changes in properties of the latter during the heat treatment.

The character of the non-wovens according to the invention is also affected by the amount of melt binders.

Depending on the area of application, a filling non-woven having only a few bonding points is preferred or an almost flat bonding joint, for example for laminates. Typical values of the amount of melt binder are in the range from 20–80% by weight of binding fiber, relative to the amounts of binding fiber and supporting fiber.

The weight per unit area of the non-wovens according to the invention and the individual titers and staple lengths of both types of fiber can be varied within wide limits and adjusted to the requirements of further processing and the area of application. Typical values of the weights per unit area are 30 to 500 g/m$^2$. Typical values of the individual titers of the fibers are in the range from 0.5 to 5 dtex.

The filaments or staple fibers from which the non-wovens according to the invention are prepared can have a virtually round cross section or else have other forms, such as dumbbell-like, kidney-like, triangular or tri- or multilobal cross sections. It is possible to use hollow fibers. Furthermore, the two types of fibers can be combined in the form of two- or multicomponent fibers, the binder component occupying at least a portion of the fiber surface.

While in the case of supporting reinforcing fibers attention is in general paid to high values for strength and modulus, the melting matrix fibers used can also be substantially nonoriented fibers.

To produce the non-woven, the supporting aramid fibers are spun in a known manner from solvents, and the thermoplastic aramids can be spun from the solution or from the melt.

The non-wovens according to the invention virtually exclusively comprise aromatic polyamides and thus have all advantages of these polymers, such as chemical and thermal stability, extremely good flame resistance and good compatibility with one another. Furthermore, they have all advantages of melt-bound non-wovens, i.e., for example good tearing and tear propagation properties.

The non-wovens according to the invention can be given customary finishes, for example by addition of antistatics, dyes or biocidal additives.

The non-wovens according to the invention can be used in particular in areas where high stabilities (chemical, thermal and mechanical) are desired. Examples of these are the use as filter materials, as insulating materials (thermal and electric) and as reinforcing materials for various substrates (for example plastics or as geotextiles).

The examples which follow describe the invention without limiting it. Amounts given are by weight unless stated otherwise.

EXAMPLES 1 to 10

General procedure concerning the production of aramid papers from fibrous pulp

Staple fibers of individual fiber titer of 1.8 dtex comprising aramids based on terephthalic acid, p-phenylenediamine, dimethylbenzidine and bis(4-aminophenoxy)benzene of cutting length 6 mm are suspended in water to give approximately 1% suspension and treated in a dissolver at approximately 1200 revolutions per minute for about 1.5 to 2 hours, resulting in fibrillation of the staple fibers. Excess water is sucked off, and the fibrous pulp obtained is suspended in water while moist and mixed with varying amounts (see Table 1) of staple fibers having a cutting length of 6 mm and being composed of meltable aramid. Meltable aramid is a copolymer based on terephthalic acid, isophthalic acid and 2,2'-bis(4aminophenoxyphenyl)propane, whose end groups are capped with benzoyl chloride.

The suspension obtained is dehydrated by filtering it off, and the filtercake obtained is placed on a hotplate of about 300° C. and dried at this temperature. The drying process is aided by treatment of the side of the filtercake facing away from the hotplate with a hot iron of about 300° C.

The papers produced in this manner can subsequently be further solidifed by treatment in a hot press. In Table 1 below, the production conditions of various aramid papers and their strengths are listed. The strength values were determined by recording the stress-strain diagrams of sample strips of the papers, 1.5 cm in width. The measurements were carried out using an Instron tester. The paper length between the clamping points was 50 mm. The strength values are based on the weight of the paper per unit area.

TABLE 1

| Production conditions and strengths per unit area | | | |
|---|---|---|---|
| Ex. No. | Amount of meltable aramid fibers (% by weight) | Pressing conditions hot press (bar, °C.) | Tear strength/ notes Weight per unit area (cN/mg/cm$^2$) |
| 1 | 5 | no hot press | 22 |
| 2 | 10 | no hot press | 13 |
| 3 | 15 | no hot press | 12 |
| 4 | 20 | no hot press | 12 |
| 5 | 30 | no hot press | 14 |
| 6 | 5 | 50, 290 | 26 parchment-like |
| 7 | 10 | 50, 290 | 12 parchment-like |
| 8 | 15 | 50, 290 | 31 parchment-like |
| 9 | 20 | 50, 290 | 22 parchment-like |
| 10 | 30 | 50, 290 | 23 parchment-like |

EXAMPLES 11 to 28

Production of aramid papers from fibrous pulp

The procedure as described in Examples 1 to 10 is repeated, except that aramid staple fibers based on terephthalic acid, p-phenylenediamine, dimethylbenzidine and bis(4-aminophenoxy)benzene of cutting length 2 mm are used. The cutting length of the aramid binding fibers is in each case, as in the above examples, 6 mm.

Details regarding the production and the properties of the papers are listed in Table 2 below.

TABLE 2

| Production conditions and strengths per unit area | | | |
|---|---|---|---|
| Ex. No. | Amount of meltable aramid fibers (% by weight) | Pressing conditions hot press (bar, °C.) | Tear strength/ notes Weight per unit area (cN/mg/cm$^2$) |
| 11 | 5 | no hot press | 60 |
| 12 | 10 | no hot press | 58 |
| 13 | 15 | no hot press | 37 |
| 14 | 20 | no hot press | 32 |
| 15 | 30 | no hot press | 34 |
| 16 | 5 | 50, 290 | 42 parchment-like |
| 17 | 10 | 50, 290 | 49 parchment-like |
| 18 | 15 | 50, 290 | 57 parchment-like |
| 19 | 20 | 50, 290 | 74 parchment-like |
| 20 | 30 | 50, 290 | 60 parchment-like |
| 21 | 5 | 100, 350 | 320 |
| 22 | 10 | 100, 350 | 260 |
| 23 | 15 | 100, 350 | 340 |
| 24 | 30 | 100, 350 | 160 |

TABLE 2-continued

| Production conditions and strengths per unit area | | | |
|---|---|---|---|
| Ex. No. | Amount of meltable aramid fibers (% by weight) | Pressing conditions hot press (bar, °C.) | Tear strength/ notes Weight per unit area (cN/mg/cm$^2$) |
| 25 | 5 | 400, 350 | 560 |
| 26 | 10 | 400, 350 | 590 |
| 27 | 15 | 400, 350 | 820 |
| 28 | 20 | 400, 350 | 200 |

We claim:

1. A solidified non-woven material formed from a mixture of supporting aramid fibers and thermoplastic aramid binding fibers whose melting point is below the melting or decomposition point of said supporting aramid fibers, wherein the solidification of the non-woven material was effected by melting of the binding fibers.

2. A non-woven material as claimed in claim 1, wherein the binding fibers were made of thermoplastic aromatic polyether amides.

3. A non-woven material as claimed in claim 2, wherein the aromatic polyether amides are compounds of the formula II

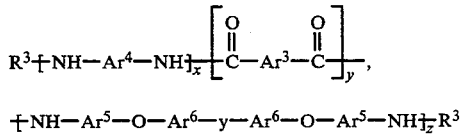

II in which $Ar^3$ is a divalent substituted or unsubstituted aromatic radical whose free valences are in the para or meta position or in a comparable parallel or angled position relative to one another, $Ar^4$ can have one of the meanings given for $Ar^3$ or is a group $—Ar^7—Z—Ar^7—$, in which Z is a $—C(CH_3)_2—$ or $—O—Ar^7—O—$ bridge and $Ar^7$ is a divalent aromatic radical, $Ar^5$ and $Ar^6$ are identical to or different from one another and are a substituted or unsubstituted para- or meta-arylene radical, Y is a $—C(CH_3)_2—$, $—SO_2—$, —S— or $—C(CF_3)_2—$ bridge, in which a) the polyether amide has an average molecular weight (number average) in the range from 5,000 to 50,000, b) molecular weight control takes place selectively by non-stoichiometric addition of the monomer units, in which the sum of the molar fractions x, y and z is one, the sum of x and z is not y and x can adopt the value zero, and c) the ends of the polymer chain are virtually completely capped by monofunctional radicals $R^3$ which do not further react in the polymer and which, independently of one another, can be identical or different.

4. A non-woven material as claimed in claim 1, wherein the supporting fibers and the binding fibers comprise aramids which are soluble in organic solvents.

5. A non-woven material as claimed in claim 4, wherein the binding fibers were made of thermoplastic aromatic polyether amides.

6. A non-woven material as claimed in claim 4, wherein said supporting aramid fibers are copolyamides soluble in organic solvents and containing at least 95 mol %, relative to the copolyamide, of recurring structural units of the formulae Ia, Ig, Ib and Id $—OC—Ar^1—CO—$, (Ia)

$—HN—Ar^2—NH—$, (Ig)

(Ib)

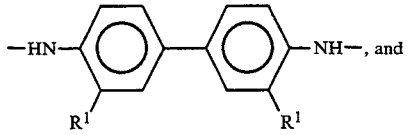

(Id)

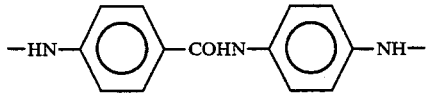

and up to 5 mol % structural units (Ie) or (If) or combinations of (Ie) and (If), structural units (Ie) and (If) being units derived from an aromatic dicarboxylic acid or from an aromatic diamine or from a combination thereof, the sums of molar proportions of structural units (Ia)+(Ie) and the molar proportion of structural units (Ig)+(Ib)+(Id)+(If) being substantially identical, and the proportions of diamine components (Ig), (Ib) and (Id) being within the following limits, relative to the total amount of diamine components:

structural units (Ig): 15 to 25 mol %,
structural units (Ib): 45 to 65 mol %,
structural units (Id): 15 to 35 mol %;

and wherein $—Ar^1—$ and $—Ar^2—$, independently of each other, are divalent aromatic radicals whose valence bonds are in the para or comparable coaxial or parallel position and which can be substituted by one or two inert radicals, and $R^1$ is a lower alkyl or lower alkoxy radical or a halogen atom.

7. A non-woven material as claimed in claim 6, wherein the binding fibers were made of thermoplastic aromatic polyether amides.

8. A non-woven material as claimed in claim 4, wherein said supporting aramid fibers are copolyamides soluble in organic solvents and containing at least 95 mol %, relative to the copolyamide, of recurring structural units of the formulae Ia, Ig, Ib and Id $—OC—Ar^1—CO—$, (Ia)

$—HN—Ar^2—NH—$, (Ig)

(Ib)

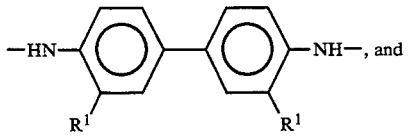

(Ic)

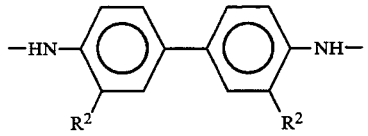

and up to 5 mol % structural units (Ie) or (If) or combinations of (Ie) and (If), structural units (Ie) and (If) being units derived from an aromatic dicarboxylic acid or from an aromatic diamine or from a combination thereof, the sums of molar proportions of structural units (Ia)+(Ie) and the molar proportion of structural units (Ig)+(Ib)+(Ic)+(If) being substantially identical, and the proportions of diamine components (Ig), (Ib) and (Ic) being within the following limits, relative to the total amount of diamine components:

structural units (Ig): 20 to 30 mol %,
structural units (Ib): 35 to 55 mol %,
structural units (Ic): 15 to 40 mol %;

and wherein

—$Ar^1$—and —$Ar^2$—, independently of each other, are divalent aromatic radicals whose valence bonds are in the para or comparable coaxial or parallel position and which can be substituted by one or two inert radicals, and $R^1$ and $R^2$, independently of one another, are lower alkyl or lower alkoxy radicals or halogen atoms.

9. A non-woven material as claimed in claim 8, wherein the binding fibers were made of thermoplastic aromatic polyether amides.

10. A non-woven material as claimed in claim 4, wherein the supporting fibers used are aramids (copolyamides) soluble in organic solvents and containing at least 95 mol %, relative to the polyamide, of recurring structural units of the formulae Ia, Ib, Ic and Id,

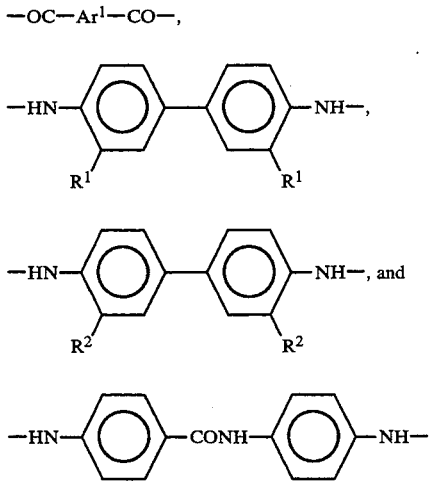

and up to 5 mol % of structural units (Ie) or (If) or combinations of (Ie) and (If), containing m-bonds and derived from aromatic dicarboxylic acids or from aromatic diamines of from combinations of aromatic dicarboxylic acids and aromatic diamines, the sums of the molar proportions of structural units (Ia)+(Ie) and the molar proportion of structural unit (Ib)+(Ic)+(Id)+(If) being substantially identical, and the proportion of diamine components (Ib), (Ic) and (Id) being within the following limits, relative to the total amount of this diamine component:

structural unit (Ib): 30–55 mol %,
structural unit (Ic): 15–35 mol %,
structural unit (Id): 20–40 mol %;

in which

—$Ar^1$— is a divalent aromatic radical whose valence bonds are in the para or comparable coaxial or parallel position and which can be substituted by one or two inert radicals, and in which —$R^1$ and —$R^2$, independently of one another, are lower alkyl radicals or lower alkoxy radicals or halogen atoms.

11. A non-woven material as claimed in claim 10, wherein the binding fibers were made of thermoplastic aromatic polyether amides.

12. A filter material, an insulating material, or a reinforcing material comprising the non-woven material as claimed in claim 1.

13. A non-woven material formed from:

supporting aramid fibers consisting essentially of a copolyamide which is soluble in an organic solvent and which contains at least 95 mol %, relative to the copolyamide, of recurring units —OC—$Ar^1$—CO— and —HN—$Ar^2$—NH —, in which —$Ar^1$—and —$Ar^2$— are divalent aromatic radicals whose valence bonds are in the para or comparable coaxial or parallel position and which are unsubstituted or substituted by one or two inert radicals, and up to 5 mol % of structural units containing m-bonds and being derived from an aromatic dicarboxylic acid or an aromatic diamine or a combination thereof, and binding fibers consisting essentially of a thermoplastic aromatic polyether amide whose melting point is below the melting or decomposition point of said supporting aramid fibers, said thermoplastic polyether amide having an average molecular weight in the range from 5000 to 50,000 and a melt viscosity not exceeding 10,000 Pas, the non-woven material being solidified by the essentially complete melting of the binding fibers.

14. A process for the production of a solidified non-woven comprising combining aramid supporting fibers and thermoplastic aramid binding fibers; forming the combined fibers into a sheet; optionally, subjecting the sheet to mechanical presolidification; and heating the sheet to effect melting of the thermoplastic aramid binding fibers and bonding of the aramid support fibers at the crossing points of the support fibers.

15. A paper formed from a mixture containing about 70 to 98% by weight, of supporting aramid fibers in the form of fibrillated staple fibers and about 2 to 30% by weight, of binding fibers comprising thermoplastic aramids which has been solidified by bonding the supporting fibers to the binding fibers by partial melting or by virtually complete melting of the binding fibers.

16. A paper as claimed in claim 15, wherein the staple lengths of the supporting aramid fibers are 2 to 6 mm and the staple length of the binding fibers was about the same as the staple length of the supporting fibers.

17. A laminate comprising a plurality of layers, at least one of the layers comprising the paper as claimed in claim 15.

18. A process for the production of the paper as claimed in claim 15 which comprises:

i) preparing an aqueous suspension of aramid supporting fibers and mechanically processing this suspension, resulting in the formation of fibrillated aramid supporting fibers, ii) mixing the fibrillated aramid supporting fibers with about 2 to 30% by weight, relative to the total amount of fibers, of binding fibers comprising thermoplastic aramids, iii) removing the suspension medium and forming a filtercake, and iv) drying and heating the filtercake to a temperature, leading to its solidification by bonding the supporting fibers to the binding fibers by partial or essentially complete melting of the binding fibers.

* * * * *